US011064820B2

(12) United States Patent
Belokin

(10) Patent No.: US 11,064,820 B2
(45) Date of Patent: Jul. 20, 2021

(54) DUAL-DIRECTIONAL DISPLAY SHELF

(71) Applicant: Displays by Martin Paul, Inc.—Creative Center, Denton, TX (US)

(72) Inventor: Martin Belokin, Denton, TX (US)

(73) Assignee: Displays by Martin Paul, Inc.—Creative Center, Denton, TX (US)

( * ) Notice: Subject to any disclaimer, the term of this patent is extended or adjusted under 35 U.S.C. 154(b) by 0 days.

(21) Appl. No.: 15/957,632

(22) Filed: Apr. 19, 2018

(65) Prior Publication Data

US 2019/0320822 A1 Oct. 24, 2019

(51) Int. Cl.

| | |
|---|---|
| ***A47F 7/00*** | (2006.01) |
| ***A47F 5/00*** | (2006.01) |
| ***A47B 81/00*** | (2006.01) |
| ***A47B 96/02*** | (2006.01) |

(52) U.S. Cl.

CPC ..... *A47F 5/005* (2013.01); *A47B 81/007* (2013.01); *A47B 96/021* (2013.01); *A47F 7/00* (2013.01); *A47F 7/0042* (2013.01); *A47F 2005/0012* (2013.01)

(58) Field of Classification Search

CPC ..... A47F 5/005; A47F 7/00; A47F 5/0006; A47F 5/0884; A47F 5/0892; A47F 5/0042; A47F 7/0042; A47B 81/007; A47B 96/021

See application file for complete search history.

(56) References Cited

U.S. PATENT DOCUMENTS 727,107 A * 5/1903 Donaldson ..... A47F 5/02 211/131.1
1,334,545 A * 3/1920 Londelius, Jr. ..... F16L 3/223 211/70.1
1,861,310 A * 5/1932 Liebendorfer ..... G07D 9/00 211/55
1,987,567 A * 1/1935 Ziemmerman ..... A47F 5/112 108/100
2,051,093 A * 8/1936 Leigh ..... A47F 5/112 211/72
2,083,973 A * 6/1937 Zimmerman ..... A47F 5/112 211/14
2,541,597 A * 2/1951 Midling ..... B25H 3/04 204/297.1
3,192,970 A * 7/1965 Allen ..... F16N 33/00 141/106
3,357,568 A * 12/1967 Leblanc ..... A47F 7/021 211/163
3,494,477 A * 2/1970 Parsons ..... A47B 81/007 211/49.1
3,543,943 A * 12/1970 Joy ..... A47F 5/05 211/131.1
D235,595 S * 7/1975 Dogliotti ..... D6/682.2
(Continued)

*Primary Examiner* — Kimberley S Wright

(57) ABSTRACT

A shelf has been disclosed, which provides a level with a support bridge, a first vertical support, and a second vertical support. The support bridge, the first vertical support, and the second vertical support forming three points in the level that support an object in alternative right or left arrangements at an angle where the objects extend upward and outward from the support bridge. In particular configurations, each of the first vertical support and the second vertical support comprise a shelving portion and each of the first vertical support and the second vertical support comprise an end support.

18 Claims, 4 Drawing Sheets

(56) References Cited

U.S. PATENT DOCUMENTS 3,942,647 A * 3/1976 Crosslen ..... A47F 5/02 211/144
D260,831 S * 9/1981 Hotchkiss ..... D6/570
4,310,094 A * 1/1982 Hotchkiss, Jr. ..... B25H 3/04 211/70.6
D264,025 S * 4/1982 Franklin ..... D6/675.4
4,632,259 A * 12/1986 Cameron ..... A47J 47/16 211/119
4,744,473 A * 5/1988 Hardy ..... A47B 87/0246 206/509
D333,050 S * 2/1993 Schubert ..... D6/678.3
5,183,166 A * 2/1993 Belokin, Jr. ..... A47F 5/116 211/130.1
5,199,577 A * 4/1993 Curtis ..... A47B 55/02 211/40
5,346,063 A * 9/1994 Chow ..... B25H 3/04 206/376
5,411,145 A * 5/1995 Parks ..... A47B 63/00 211/50
D370,137 S * 5/1996 David ..... D6/407
5,579,930 A * 12/1996 Brendle ..... B62B 3/006 211/151
5,636,751 A * 6/1997 Frank ..... A47B 61/04 211/163
D394,980 S * 6/1998 Goodman ..... D6/630
5,934,487 A * 8/1999 Hoeg ..... A47B 63/00 211/13.1
D426,401 S * 6/2000 Conway, Jr. ..... D6/661
D429,436 S * 8/2000 Belokin ..... D6/570
6,189,706 B1 * 2/2001 Akins ..... A47B 81/00 211/106
6,302,369 B1 * 10/2001 Liebers ..... A47F 7/021 248/205.3
6,315,121 B1 * 11/2001 Hansen ..... B25H 3/04 206/376
D462,222 S * 9/2002 Palmer ..... D6/630
D493,326 S * 7/2004 Hassett ..... A47B 43/02 D6/630
6,758,350 B2 * 7/2004 Lin ..... B25H 3/04 206/376
6,899,235 B2 * 5/2005 Hassett ..... A47B 43/02 211/40
D523,681 S * 6/2006 Dardashti ..... D6/630
D590,635 S * 4/2009 Beckerman ..... D6/683.1
7,987,975 B1 * 8/2011 Lee ..... B25H 3/04 206/376
8,261,911 B2 * 9/2012 Lee ..... B25H 3/04 206/372
8,844,733 B2 * 9/2014 Waksul ..... A47B 81/04 211/41.2
9,505,123 B2 * 11/2016 Johnson ..... B25B 15/008
D833,172 S * 11/2018 Belokin ..... D6/570
10,405,651 B1 * 9/2019 Kramer ..... A47B 46/005
2005/0274684 A1 * 12/2005 Swanson ..... A47B 43/02 211/78
2005/0284825 A1 * 12/2005 Goldsmith ..... A47F 3/002 211/4
2009/0152219 A1 * 6/2009 Brida ..... A47B 73/00 211/49.1
2010/0025344 A1 * 2/2010 Virvo ..... A47F 5/116 211/59.2
2011/0073553 A1 * 3/2011 Buege ..... A47F 5/04 211/59.4
2012/0248050 A1 * 10/2012 Heintz ..... A47F 3/142 211/59.2
2014/0367350 A1 * 12/2014 Waksul ..... A47B 81/04 211/41.2
2015/0129518 A1 * 5/2015 Ho ..... A47J 47/16 211/41.2
2015/0250333 A1 * 9/2015 Schaefer ..... A47F 5/08 211/89.01
2016/0249753 A1 * 9/2016 Waksul ..... A47G 19/08 211/41.2
2018/0146803 A1 * 5/2018 Urban ..... B65D 5/0218
2018/0160825 A1 * 6/2018 Abel ..... B65D 5/5213
2018/0289178 A1 * 10/2018 McMillan-Sweat .... A47F 5/116
2019/0313792 A1 * 10/2019 Kusik ..... A47B 81/00
2020/0029688 A1 * 1/2020 Kramer ..... A47B 63/00

* cited by examiner

DUAL-DIRECTIONAL DISPLAY SHELF

TECHNICAL FIELD

This disclosure is generally directed to display shelves. More specifically, this disclosure is directed to a dual-directional display shelf.

BACKGROUND

A problem that arises with point of purchase cooler display shelves relates to the fact that cooler doors open in different directions. Certain types of display shelves are specifically oriented to the direction the door opens. These displays shelves often have two models referred to as left or right arrangements for a single design. When such left and right arrangements exist for such shelves, a customer may unfortunately purchase the wrong shelf for a particular door. Additionally, two models must be created for each design.

SUMMARY OF THE DISCLOSURE

A shelf has been disclosed, which provides a level with a support bridge, a first vertical support, and a second vertical support. The support bridge, the first vertical support, and the second vertical support form three points in the level that support an object in alternative right or left arrangements at an angle where the objects extends upward and outward from the support bridge. In particular configurations, each of the first vertical support and the second vertical support comprise a shelving portion and each of the first vertical support and the second vertical support comprise an end support.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The phrase "at least one of," when used with a list of items, means that different combinations of one or more of the listed items may be used, and only one item in the list may be needed. For example, "at least one of: A, B, and C" includes any of the following combinations: A; B; C; A and B; A and C; B and C; and A and B and C. Definitions for certain words and phrases are provided throughout this patent document, those of ordinary skill in the art should understand that in many if not most instances, such definitions apply to prior, as well as future uses of such defined words and phrases.

Additionally, it should be understood that while certain advantages may be described with reference to certain embodiments, other embodiments may have some or none of such advantages.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The FIGURES described below, and the various embodiments used to describe the principles of the present disclosure in this patent document are by way of illustration only and should not be construed in any way to limit the scope of the disclosure. Those skilled in the art will understand that the principles of the present disclosure invention may be implemented in any type of suitably arranged device or system. Additionally, the drawings are not necessarily drawn to scale.

A problem that arises with point of purchase cooler display shelves relates to the fact that cooler doors open in different directions. Certain types of display shelves are specifically oriented to the direction the door opens. These displays shelves often have two models referred to as left or right arrangements for a single design. When such left and right arrangements exist for such shelves, a customer may unfortunately purchase the wrong shelf for a particular door. Additionally, two models must be created for each design.

To alleviate such concerns, certain embodiments of the disclosure provide a display shelf that is dual-directional. That is, a single shelf can be used on both left and right doors—while still retaining certain qualities traditionally reserved for left or right arrangement models. In particular configurations, such a dual-directional design is accomplished by having dual purpose features that re-use particular components for a left arrangement and right arrangement.

While providing such a dual-directional design, certain embodiments of the disclosure further minimize materials used to provide such a dual-directional shelf—resulting in manufacturing and shipping efficiencies. In yet other configurations, while minimizing materials, certain configurations provide support mechanisms in certain places to balance structural integrity with minimal materials.

Figure 1:
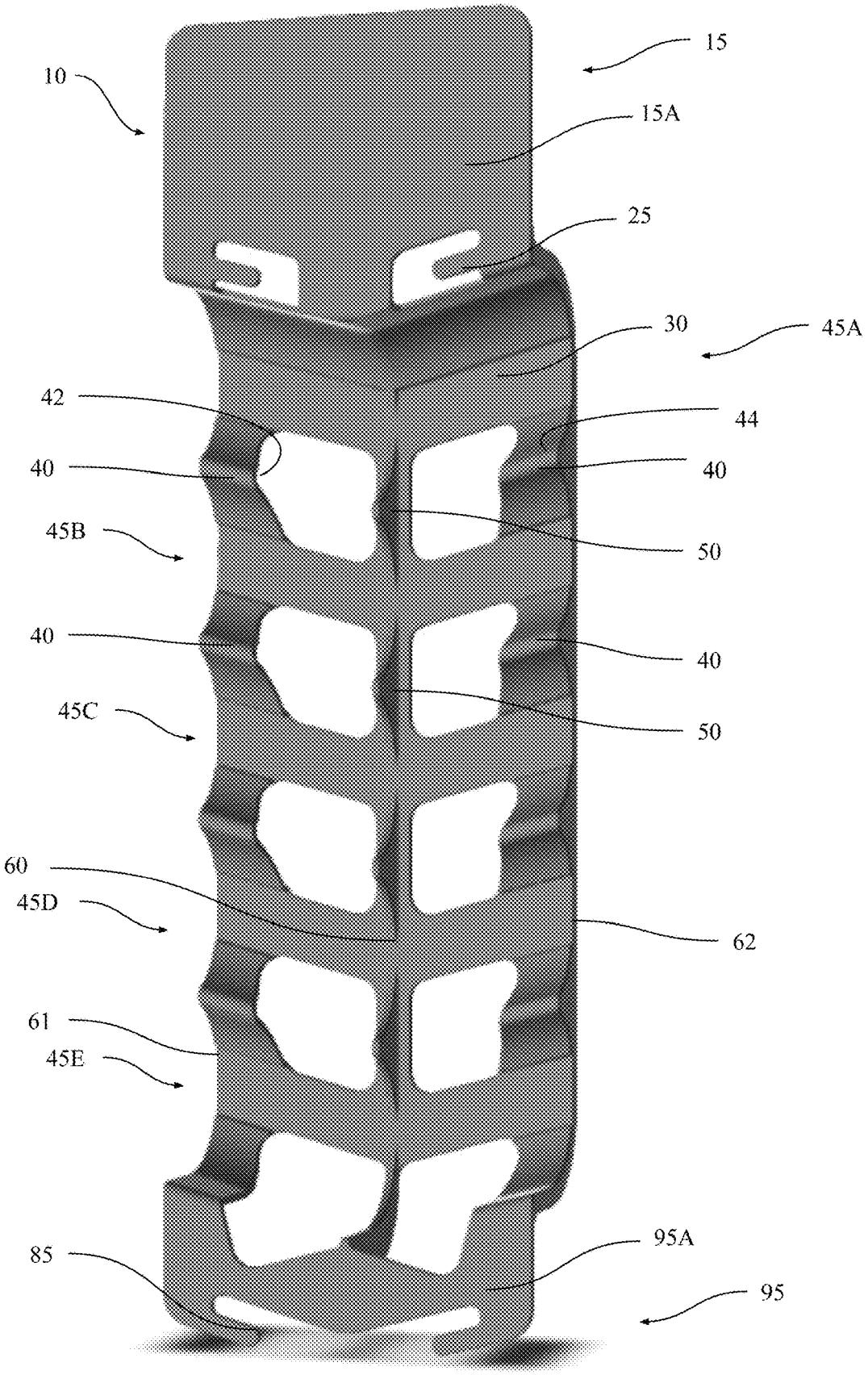
FIG. 1 shows a front view of a shelf, according to an embodiment of the disclosure.

FIG. 1 shows a front perspective view of a shelf 10, according to an embodiment of the disclosure. This front perspective view is from the perspective of one who might be looking through a glass cooler at the shelf 10. In FIG. 1, the shelf 10 has a first end 15 with a first face 15A and a second end 95 with a first face 95A. Adjacent the first end 15 are suction cup mounting brackets 25. Adjacent the second end 95 are suction cup mounting brackets 85. In particular configurations, the respective mounting brackets 25, 85 may support POWER CUP® suctions cups sold by Displays by Martin Paul, Inc. of Denton, Tex. Other configurations with other types of suctions cups may also avail from the teachings of this disclosure. In particular configurations, the face may support positioning of an advertisement for objects to be positioned on the shelf.

Although a particular configuration for mounting the shelf 10 to a plane (e.g. a glass door) have been shown in FIG. 1, one of ordinary skill in the art will recognize that other mounting techniques may be utilized in other configurations. Additionally, although described as being mounted to a plane, one of ordinary may also mount other designs disclosed herein to other items using other coupling techniques.

The first end 15 and the second end 95 of the shelf 10 interface with the plane of another item (e.g., a glass cooler door) to which the shelf is coupled (e.g., using suction cups or the like). When a suction cup (e.g., POWER CUP® suctions cup sold by Displays by Martin Paul, Inc. of Denton, Tex.) is utilized, the suction cup contacts the plane as the coupling mechanism. The respective first faces 15A, 95A of the first and second ends 15, 95 are the next closest structural component of the shelf 10 to the plane. In certain embodiments, the first faces 15A, 95A may contact the plane. In other embodiments, the first faces 15A, 95A may not contact the plane. In supporting the remainder of the shelf 10, the first end 15 generally creates a tensile force upward on the shelf 10 (as the shelf 10 hangs downward therefrom) whereas the second end 95 creates a compressive forward upward (pushing up on the holding the shelf 10).

The shelf 10 itself generally holds the object contained therein right up against the plane. In particular configurations, there is generally no component of the shelf 10 between an object being held and the plane. When the plane is glass, such a configuration desirably maximizes the view of the object being displayed in the shelf 10.

Figure 2:
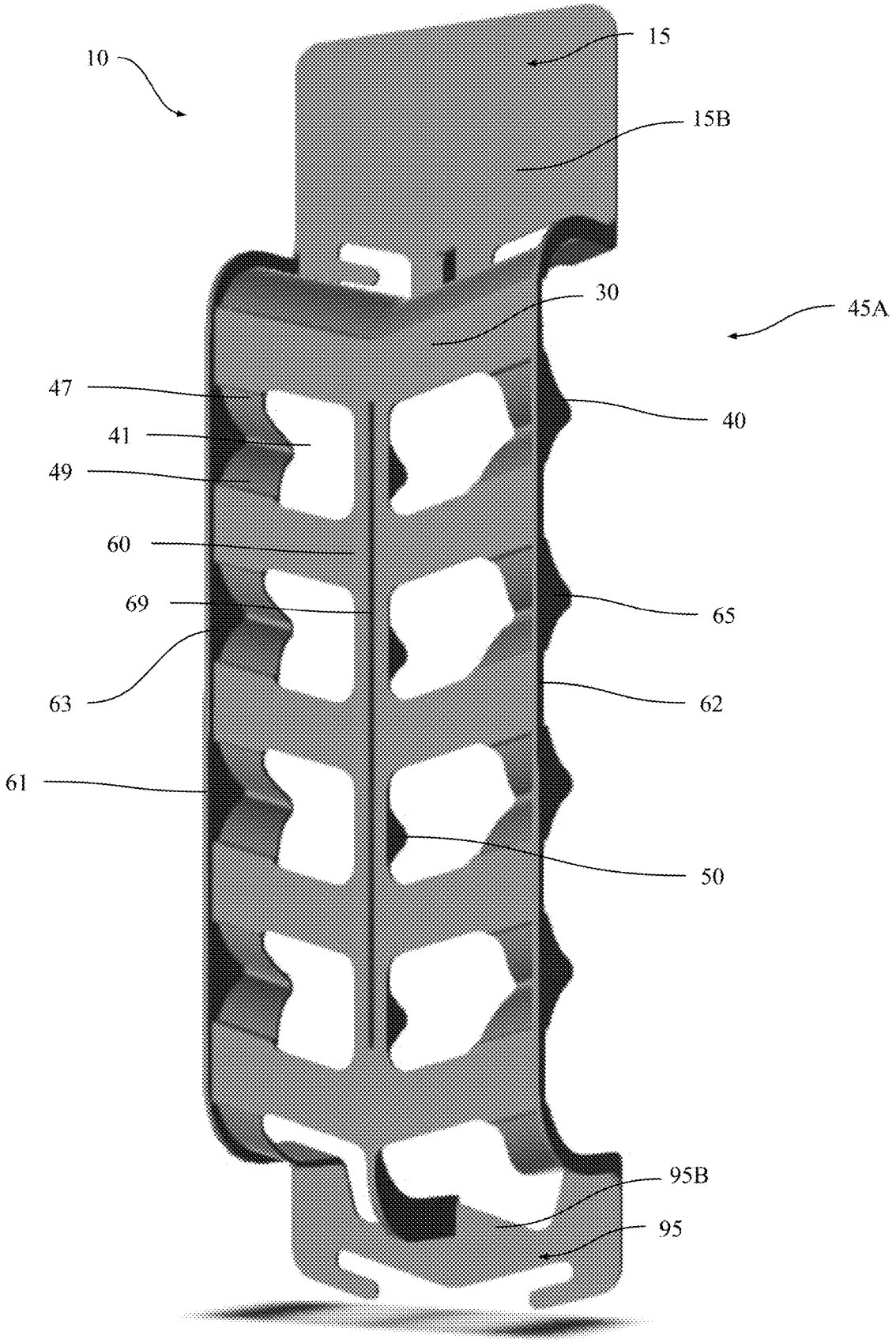
FIG. 2 shows a backside view of the shelf, according to an embodiment of the disclosure.

Between the respective first and second ends 15, 05, much of the structural support is provided by three spines that are seen more clearly in FIG. 2: center spines and first and second edge spines 61, 62). These spines 60, 61, and 62 are designed to maximize support while minizine materials needed for such support. According to particular configurations, the reduced material not only reduces manufacturer costs, but also reduces shipping costs attributable to weight.

In addition to the spine 60, 61, and 62, the shelf 10 may generally be viewed as containing material that forms a webbing that interconnects a plurality of different levels 45A, 45B, 45C, 45D, and 45E. A portion of such webbing is a retaining portion 30 in each level, for example as labeled in level 45A. Such a retaining portion 30 prevents a particular object being stored in the shelf from falling, for example, into a cooler. Further webbing discussion is provided below with reference to FIG. 2.

Each of the levels 45A, 45B, 45C, 45D, and 45E also include two vertical supports 40 and a support bridge 50 that is interconnected to the spine 60. The respective vertical supports 40 are angled downward towards the support bridge 50. Each vertical support 40 includes an end support 42 and shelving support 44. The shelving support 44 in particular configurations may be configured to correspond to the shape of the object being supported thereon. In FIG. 1, the shelving support 44 is rounded to support tubular objects; however, in other configurations, the shelving support 44 may take on other configurations and shapes. To support tubular objects, in this configuration, the vertical supports 40 and support bridges 50 take on the shape of a curvilinear bell curve when viewed from a plane orthogonal the plane of the face 15A (e.g., a side view). In other configurations, the vertical supports 40 and support bridges 50 may have other configurations.

In supporting the alternative arrangements of objects on a particular level, both vertical supports 40 and the support bridge 50 are utilized as described below.

Although six levels 45A, 45B, 45C, 45D, and 45E are shown in the configuration of FIG. 1, more than or less than five levels may be utilized in other configurations.

While the configuration of FIG. 1 is generally described as having alternative configurations, the levels may provide different options. For example, in some configurations, all the objects may be stored on the shelf 10 all on one side (e.g., left or right). In other configurations, the objects may be stored on alternating sides per left (e.g., left, right, left right). In particular configurations, given the re-use of components in the shelf 10 as described below, only one object may be stored on each level in particular configurations.

FIG. 2 shows a backside perspective view of the shelf 10, according to an embodiment of the disclosure. The second face 15B of first end 15 and the second face 95B of second end 95 can be seen. From the view of FIG. 2, one may see the center spine 60 and first and second edge spines 61 and 62 extending between first end 15 and the second end 95 of the shelf 10. In addition to the spines 60, 61, and 62 the various levels 45A, 45B, 45C, 45D, 45E, and 45F (labeled in FIG. 1) are interconnected by other webbing pieces balancing structural integrity with reduced material. As seen in FIG. 2, the spine also may include a ridge 69 that provides additional structural integrity while minimizing material use. Also seen in FIG. 2 are edge pieces 63, 65 that extend from respective first and second edge spines 61 and 62. The edge pieces 63 and 65 in this configuration generally have the same shape as the vertical supports 40. These edge pieces 63, 65 provide structural support for the vertical supports 40. Other configurations may have different designs.

With reference to level 45A, extending between the spine 60 and respective first and second edge spines 61 and 62. On each level is the retaining portion 30. Extending from the retaining portion 30 are web interconnects 47, 49 of a vertical support 40. In the configuration shown, the web interconnects 47, 49 are curvilinear and form the bell curve shape of the vertical support on the oppose side. In other configurations, the web interconnects 47, 49 may have different shapes.

These webbing features provide open spaces 41 that minimize materials (while retaining structural integrity). Such open spaces 41 also allow the objects being stored to be viewed without additional potential obstruction by the shelf 10.

One may also see how the support bridge 50 extends from the spine 60.

Figure 3A:
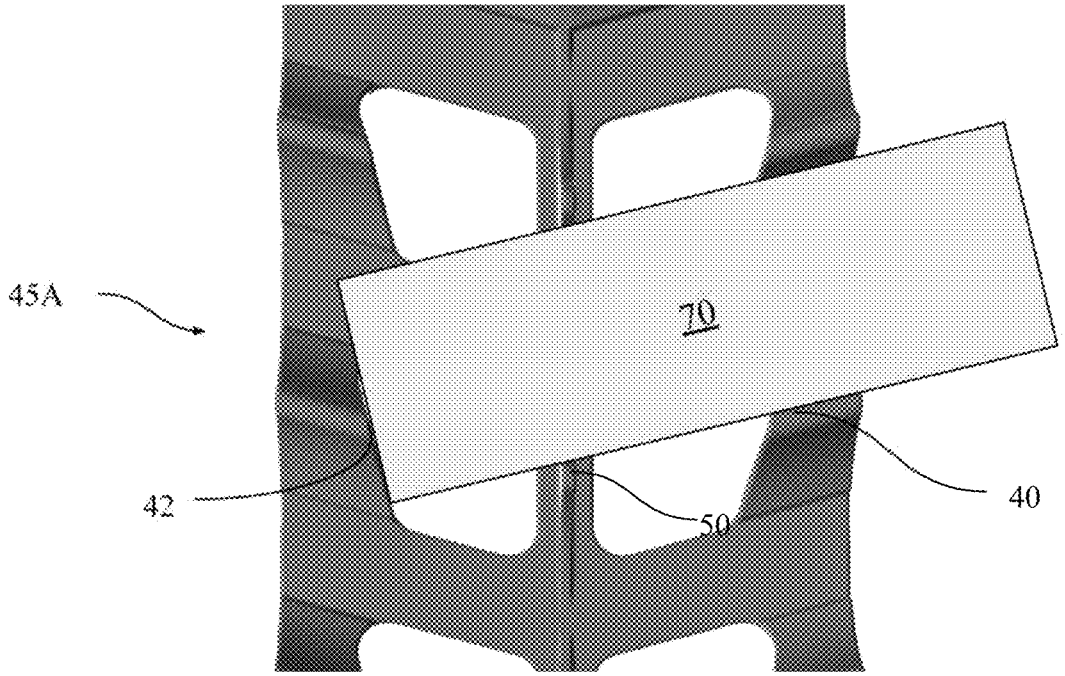
FIGS. 3A and 3B show the alternative positioning of an object in a shelf for a particular same level, according to an embodiment of the disclosure.
Figure 3B:
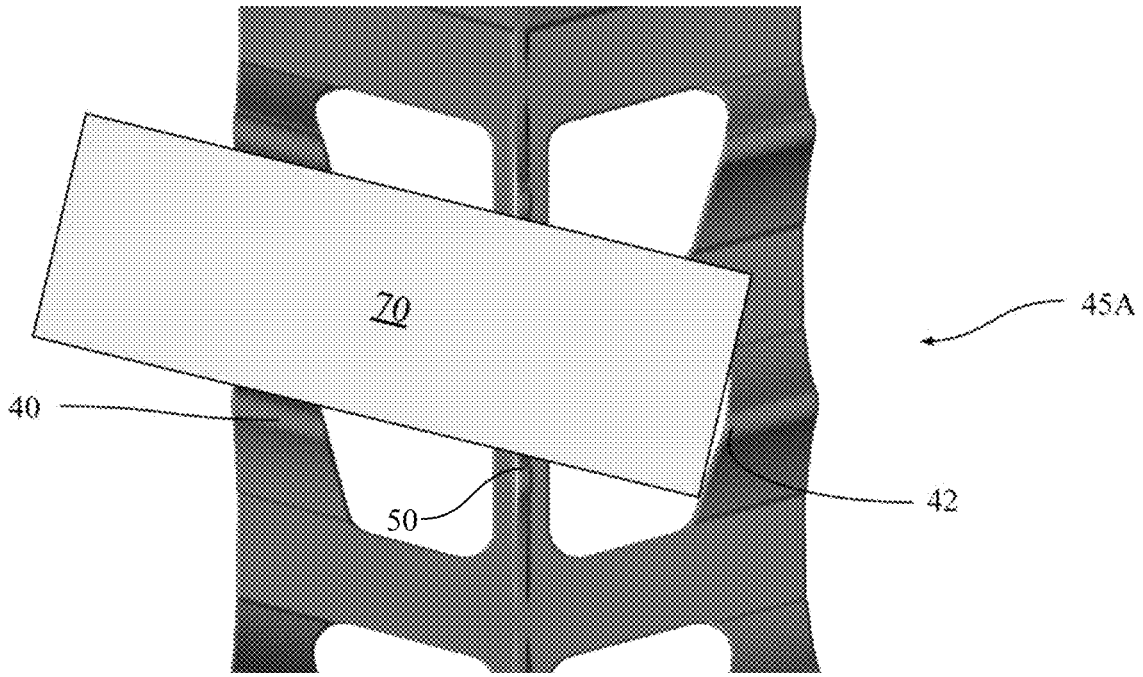

FIGS. 3A and 3B show the alternative positioning of an object 70 for a particular same level, according to an embodiment of the disclosure. In FIGS. 3A and 3B, a zoomed-in portion for level 45A of FIG. 1 is shown. FIG. 3A shows an object 70 positioned from the right side of the shelf 10 whereas FIG. 3B shows how the same object 70 can, also, be positioned from the left side of the shelf 10.

When positioned from the right side of the shelf 10 as seen in FIG. 3A, a vertical support 40 on the same corresponding right side vertically supports the object 70, for example, using the shelving support 44 (not seen from this view, but shown in FIG. 1). And, an end support 42 on the opposing left side (e.g., of the same level 45A) provides support.

When positioned from the left side of the shelf 10 as seen in FIG. 3B, a vertical support 40 on the same corresponding left side vertically supports the object 70, for example, using the shelving support 44 (not seen from this view, but shown in FIG. 1). And, an end support 42 on the opposing right side (e.g., of the same level 45A) provides support.

For both FIGS. 3A and 3B, the support bridge 50 is used (or, reused) for both orientations to provide further support.

Thus, as can be seen in the configuration of FIGS. 3A and 3B, the object 70 is supported from three points for a particular level—the shelving support 44, the end support 42, and the support bridge 50. In particular configurations, the shelving support 44 may effectively be reduced to a point where the end support 42 and shelving support 44 are seen as one in the same (given both are part of the vertical support 40). Viewed from such a perspective, all three are used/re-used—regardless of the mounting arrangement, left or right.

The object 70 may be a variety of materials, including cans, plastic bottles, and the like. The shelf may be made of any suitable material including, but not limited to plastic.

Figure 4A:
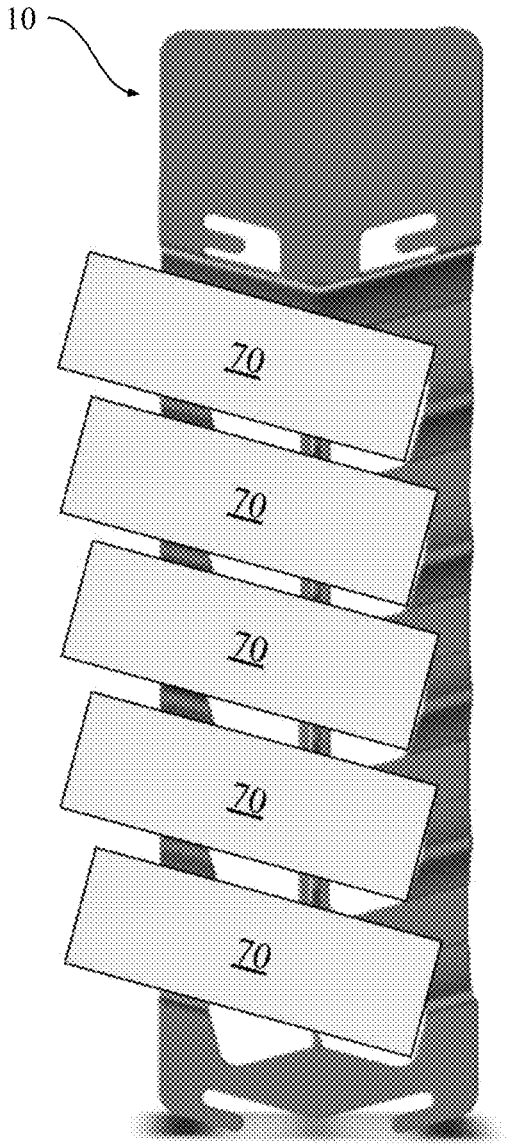
FIGS. 4A and 4B show positioning of multiple objects in respective left and right arrangement for the same shelf.
Figure 4B:
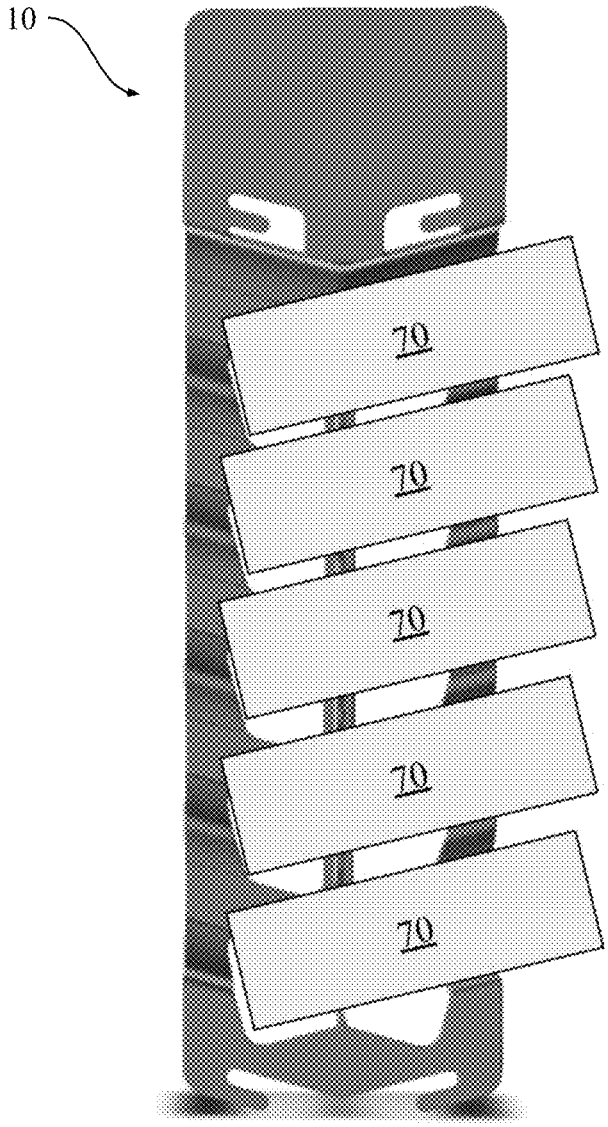

FIGS. 4A and 4B show positioning of multiple objects 70 in respective left and right arrangement for the same shelf 10. While five levels are shown in these configurations, the shelf may include more than or less than five levels. Additionally, the shelf may be adapted to accommodate objects of different shapes—including non-tubular objects.

It will be understood that well known features have not been described in detail and have been omitted for brevity. Although specific structures and materials may have been described, the present disclosure is not limited to these specifics, and others may substituted as is well understood by those skilled in the art, and various steps may not necessarily be performed in the sequences shown.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A shelf comprising:

a plurality of levels vertically stacked on top of one another, each level containing a support bridge, a first vertical support, and a second vertical support, wherein the support bridge, the first vertical support, and the second vertical support form three points in the level that vertically support an object alternatively in one of a left arrangement in which the object extends outwardly at an angle from a left side of the shelf and a right arrangement in which the object extends outwardly at an angle from a right side of the shelf, the object supported by each of the three points when positioned in either the left arrangement or the right arrangement; and a first end and a second end coupled to the plurality of levels, the first end and the second end to be releasably coupled to a planar surface such that the object is held against the planar surface.

2. The shelf of claim 1, wherein for each of the plurality of levels:

each of the first vertical support and the second vertical support comprises an end support;

the right arrangement of the object in the level is supported by the end support of the first vertical support, the second vertical support, and the support bridge; and the left arrangement of the object in the level is supported by the end support of the second vertical support, the first vertical support, and the support bridge.

3. The shelf of claim 2, wherein for each of the plurality of levels:

each of the first vertical support and the second vertical support comprises a shelving portion;

the right arrangement of the object in the level is supported by the end support of the first vertical support, the shelving portion of the second vertical support, and the support bridge; and the left arrangement of the object in the level is supported by the end support of the second vertical support, the shelving portion of the first vertical support, and the support bridge.

4. The shelf of claim 3, wherein for each of the plurality of levels the shelving portion of the first vertical support and the second vertical support is rounded to support a tubular object.

5. The shelf of claim 1, wherein for each of the plurality of levels a portion of the first vertical support and the second vertical support is rounded to support a tubular object.

6. The shelf of claim 1, wherein for each of the plurality of levels each of the alternative right and left arrangement supports the object at an angle such that the object extends upward and outward from the support bridge.

7. A shelf comprising:

a plurality of levels vertically stacked on top of one another, each level containing a first vertical support, and a second vertical support, and a support bridge between the first vertical support and the second vertical support, wherein the support bridge, the first vertical support, and the second vertical support form three points in the level that vertically support an object alternatively in one of a left arrangement in which the object extends outwardly and upwardly at an angle from a left side of the shelf and a right arrangement in which the object extends outwardly and upwardly at an angle from a right side of the shelf, the alternative positioning in the left or right arrangement preventing the other arrangement for the level, the object supported by each of the three points when positioned in either the left arrangement or the right arrangement; and a first end and a second end coupled to the level, the first end and the second end to be releasably coupled to a planar surface such that the object is held against the planar surface.

8. The shelf of claim 7, wherein for each of the plurality of levels:

each of the first vertical support and the second vertical support comprises an end support;

the right arrangement of the object in the level is supported by the end support of the first vertical support, the second vertical support, and the support bridge; and the left arrangement of the object in the level is supported by the end support of the second vertical support, the first vertical support, and the support bridge.

9. The shelf of claim 8, wherein for each of the plurality of levels:

each of the first vertical support and the second vertical support comprises a shelving portion;

the right arrangement of the object in the level is supported by the end support of the first vertical support, the shelving portion of the second vertical support, and the support bridge; and the left arrangement of the object in the level is supported by the end support of the second vertical support, the shelving portion of the first vertical support, and the support bridge.

10. The shelf of claim 9, wherein for each of the plurality of levels the shelving portion of the first vertical support and the second vertical support is rounded to support a tubular object.

11. The shelf of claim 7, further comprising:

a spine connecting the plurality of levels between the first end and the second end.

12. The shelf of claim 11, further comprising:

webbing between respective levels, the webbing connecting the first vertical support of a first level with the first vertical support of a second level, the webbing forming at last two open spaces in the shelf between the first and second levels.

13. The shelf of claim 12, wherein the webbing is curvilinear.

14. A shelf comprising:

a plurality of levels vertically stacked on top of one another, each level containing a support bridge, a first vertical support, and a second vertical support, wherein the support bridge, the first vertical support, and the second vertical support form three points in the level that vertically support an object alternatively in one of a left arrangement in which the object extends outwardly at an angle from a left side of the shelf and a right arrangement in which the object extends outwardly at an angle from a right side of the shelf;

a first end and a second end coupled to the plurality of levels, the first end and the second end to be releasably coupled to a planar surface such that the object is held against the planar surface;

a spine connecting the plurality of levels between the first end and the second end; and webbing between respective levels, the webbing connecting the first vertical support of a first level with the first vertical support of a second level, the webbing forming at least two open spaces in the shelf between the first and second levels.

15. The shelf of claim 14, wherein the webbing is curvilinear.

16. The shelf of claim 14, wherein for each of the plurality of levels:

each of the first vertical support and the second vertical support comprises an end support;

the right arrangement of the object in the level is supported by the end support of the first vertical support, the second vertical support, and the support bridge; and the left arrangement of the object in the level is supported by the end support of the second vertical support, the first vertical support, and the support bridge.

17. The shelf of claim 16, wherein for each of the plurality of levels:

each of the first vertical support and the second vertical support comprises a shelving portion;

the right arrangement of the object in the level is supported by the end support of the first vertical support, the shelving portion of the second vertical support, and the support bridge; and the left arrangement of the object in the level is supported by the end support of the second vertical support, the shelving portion of the first vertical support, and the support bridge.

18. The shelf of claim 14, wherein for each of the plurality of levels each of the alternative right and left arrangement supports the object at an angle such that the object extends upward and outward from the support bridge.

* * * * *